US009495887B2

(12) United States Patent
Quick et al.

(10) Patent No.: US 9,495,887 B2
(45) **Date of Patent: *Nov. 15, 2016**

(54) TARGETS AND METHODS OF MANUFACTURING SAME

(71) Applicant: Ward Kraft, Inc., Fort Scott, KS (US)

(72) Inventors: Phillip Quick, Fort Scott, KS (US); Ryan Kraft, Fort Scott, KS (US); Greg Fess, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/705,567

(22) Filed: May 6, 2015

(65) Prior Publication Data

US 2015/0235573 A1 Aug. 20, 2015

Related U.S. Application Data

(63) Continuation-in-part of application No. 14/031,801, filed on Sep. 19, 2013, now Pat. No. 9,053,642, which is a continuation-in-part of application No. 13/566,669, filed on Aug. 3, 2012, now Pat. No. 8,869,438, which is a continuation of application No. 12/984,419, filed on Jan. 4, 2011, now Pat. No. 8,601,727.

(60) Provisional application No. 61/308,662, filed on Feb. 26, 2010, provisional application No. 61/348,389, filed on May 26, 2010.

(51) Int. Cl.

| | |
|---|---|
| ***G09F 1/00*** | (2006.01) |
| ***G09F 7/12*** | (2006.01) |
| ***G09F 1/06*** | (2006.01) |

(52) U.S. Cl.

CPC ..... *G09F 1/06* (2013.01)

(58) Field of Classification Search

USPC ..... 40/124.16, 539

See application file for complete search history.

(56) References Cited

U.S. PATENT DOCUMENTS

| | | | | |
|---|---|---|---|---|
| 1,669,782 | A | 5/1928 | Risser | |
| 1,821,025 | A | 9/1931 | Ohlson | |
| 2,106,153 | A * | 1/1938 | Mull | G09F 1/04 40/124.16 |
| 2,270,763 | A | 1/1942 | Nofziger | |
| 3,624,688 | A | 11/1971 | Miller | |

(Continued)

OTHER PUBLICATIONS

U.S. Appl. No. 12/984,419 Office Action dated Dec. 3, 2012, 10 pages.

(Continued)

*Primary Examiner* — Joanne Silbermann

(74) *Attorney, Agent, or Firm* — Lathrop & Gage LLP

(57) ABSTRACT

A target of unitary construction comprises a self-supporting sign having a middle portion that has a first side, a second side, an upper side, and a lower side. A first foldable flap extends from the first side and is configured to be folded along the first side in a use configuration. A second foldable flap extends from the second side and is configured to be folded along the second side in the use configuration. A front foldable portion of the sign extends from the lower side and is configured to be folded along the lower side in the use configuration. The front foldable portion is configured to be secured to a surface when the self-supporting sign is being used as a target. In the use configuration, each of the first foldable flap directly and the second foldable flap directly touch only the middle portion and the surface.

21 Claims, 22 Drawing Sheets

(56) References Cited

U.S. PATENT DOCUMENTS

| | | | | |
|---|---|---|---|---|
| 5,303,668 | A | 4/1994 | Huang | |
| 5,564,208 | A | 10/1996 | Bergman | |
| 5,660,365 | A * | 8/1997 | Glick | A47F 5/10 248/174 |
| 2005/0172529 | A1 | 8/2005 | Bourgoin et al. | |
| 2012/0145870 | A1 * | 6/2012 | Badorini | A47B 23/044 248/459 |

OTHER PUBLICATIONS

U.S. Appl. No. 12/984,419 Response to Office Action filed Feb. 13, 2013, 26 pages.

U.S. Appl. No. 12/984,419 Office Action dated Jul. 24, 2013, 6 pages.

U.S. Appl. No. 12/984,419 Response to Office Action filed Aug. 29, 2013 7 pages.

U.S. Appl. No. 12/984,419 Notice of Allowance dated Sep. 9, 2013, 6 pages.

U.S. Appl. No. 13/566,669 Office Action dated Mar. 7, 2014, 14 pages.

U.S. Appl. No. 13/566,669 Notice of Allowance dated Jul. 23, 2014, 10 pages.

U.S. Appl. No. 14/031,801 Select File History dated Dec. 19, 2013 through Oct. 29, 2014, 52 pages.

* cited by examiner

TARGETS AND METHODS OF MANUFACTURING SAME

RELATED APPLICATIONS

This application is a continuation-in-part of U.S. patent application Ser. No. 14/031,801, filed Sep. 19, 2013; which is a continuation-in-part of U.S. patent application Ser. No. 13/566,669, filed Aug. 3, 2012, now U.S. Pat. No. 8,869,438; which is a continuation-in-part of U.S. patent application Ser. No. 12/984,419, filed Jan. 4, 2011, now U.S. Pat. No. 8,601,727; which claims priority to U.S. Provisional Patent Application Ser. No. 61/308,662, filed Feb. 26, 2010, and U.S. Provisional Patent Application Ser. No. 61/348,389, filed May 26, 2010. Priority is claimed to each of these applications, and the contents of each are incorporated herein by reference in their entirety.

FIELD OF THE INVENTION

The invention relates to the field of targets.

BACKGROUND OF THE INVENTION

The prior art includes, for example, signs 10, 20 such as those shown in FIGS. 1 through 2*b*. While presumably sufficient for their intended purpose, the prior art signs 10, 20 suffer from various shortcomings. For example, the sign 10 requires use of a support 12 coupled to a base 11, and printed material 13 cannot stand on its own; it must be inserted in the support 12 (shown by arrow 15). The sign 20 can stand without having a separable base. However, to use the sign 20, the sign must first be folded about fold lines 21, 22, 23, and lower portions 24*a*, 24*b* must be coupled together (e.g., using adhesive, by mating tab 25*a* to slot 25*b*, et cetera). Further, because of its configuration, relatively large amounts of material may be required to construct the sign 20. Moreover, it may be undesirable to use these prior art signs also as targets. For example, the support 12 of the sign 10 may be made of material off which projectiles undesirably ricochet, and the sign 20 may be easily displaced when a projectile strikes its surface. The present invention relates to signs and targets, and signs that can also be used as targets.

SUMMARY

The invention relates to targets, and signs that may be also be configured as targets. According to an embodiment, a target of unitary construction comprises a self-supporting sign. The self-supporting sign has a middle portion having a first side, a second side, an upper side, and a lower side. A first foldable flap extends from the first side, and is configured to be folded along the first side in a use configuration. A second foldable flap extends from the second side and is configured to be folded along the second side in the use configuration. A front foldable portion of the sign extends from the lower side. The front foldable portion is configured to be folded along the lower side in the use configuration. The front foldable portion is configured to be secured to a surface when the self-supporting sign is being used as a target. In the use configuration, the first foldable flap directly touches only the middle portion and the surface, and the second foldable flap directly touches only the middle portion and the surface.

According to another embodiment, a target of a unitary construction a base portion having a first edge, a second edge, a first top edge, a second top edge spaced apart from the first top edge, and a bottom edge. The base portion is configured to be secured to a surface. A foldable portion extends from the base portion and is situated between the first top edge and the second top edge in a storage configuration. The foldable portion has a first border, a second border, a top border, and a bottom border. The first border has a first perforated portion that is inwardly adjacent the first top edge and extends from the first top edge to the bottom border. The second border has a second perforated portion that is inwardly adjacent the second top edge and extends from the second top edge to the bottom border. The foldable portion is configured to be folded along the bottom border in a use configuration after the first perforated border and the second perforated border are each detached from the base portion.

BRIEF DESCRIPTION OF THE SEVERAL VIEWS OF THE DRAWINGS

Illustrative embodiments of the present invention are described in detail below with reference to the attached drawing figures and wherein.

DETAILED DESCRIPTION

Embodiments of the present invention provide self-supporting signs, targets, and methods of making and using same.

Figure 1:
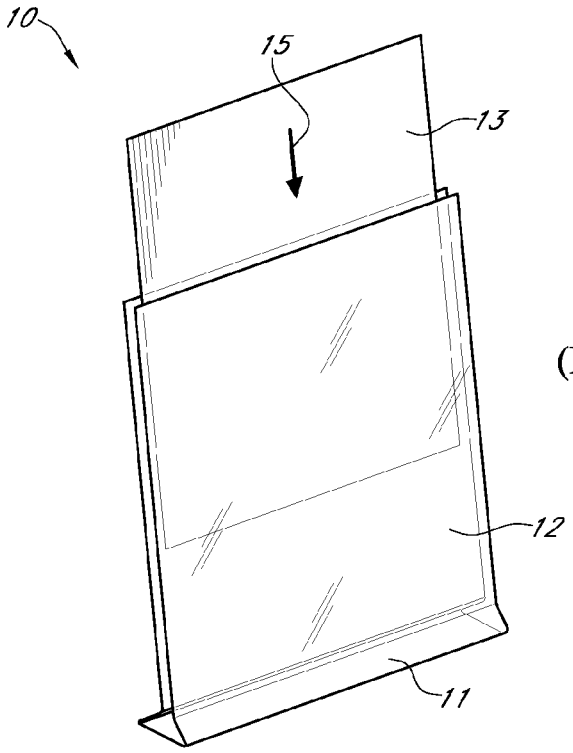
FIG. 1 (PRIOR ART)
FIG. 1 shows a perspective view of a PRIOR ART sign.
Figure 2A:
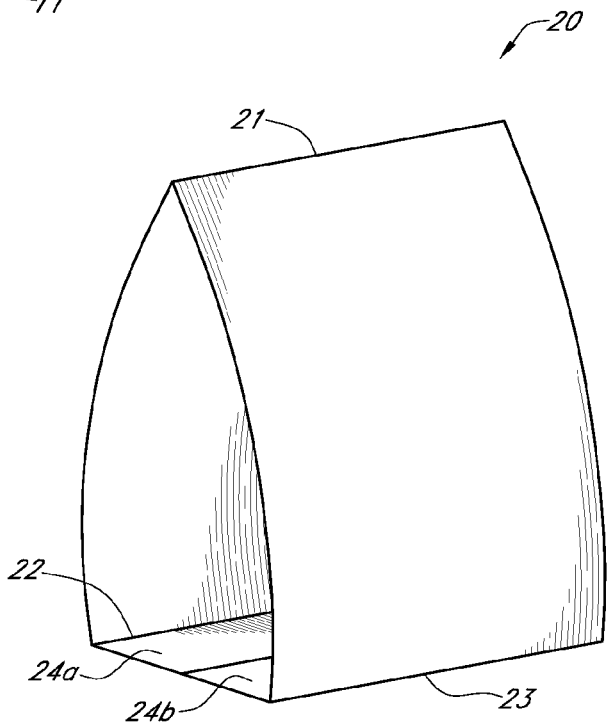
FIG. 2a (PRIOR ART)
FIG. 2*a* shows a perspective view of another PRIOR ART sign.
Figure 2B:
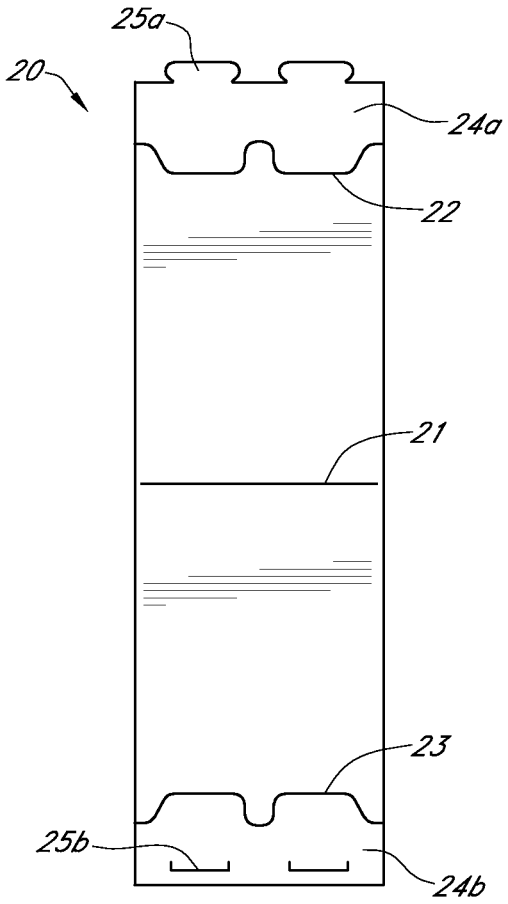
FIG. 2b (PRIOR ART)
FIG. 2*b* shows the PRIOR ART sign of FIG. 2 before being folded and secured.
Figure 3:
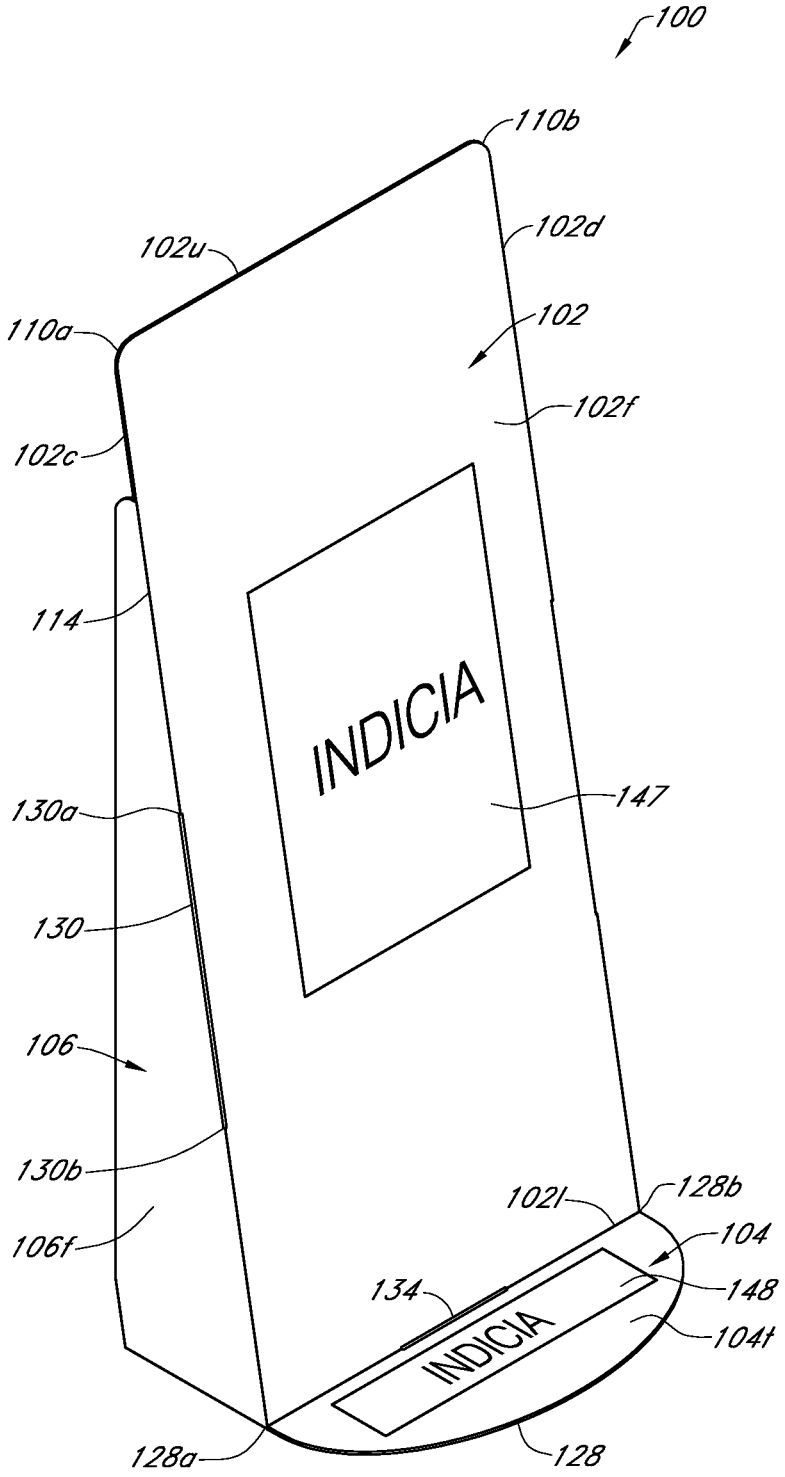
FIG. 3 shows a perspective view of a self-supporting sign according to an inventive embodiment, configured for use.
Figure 4:
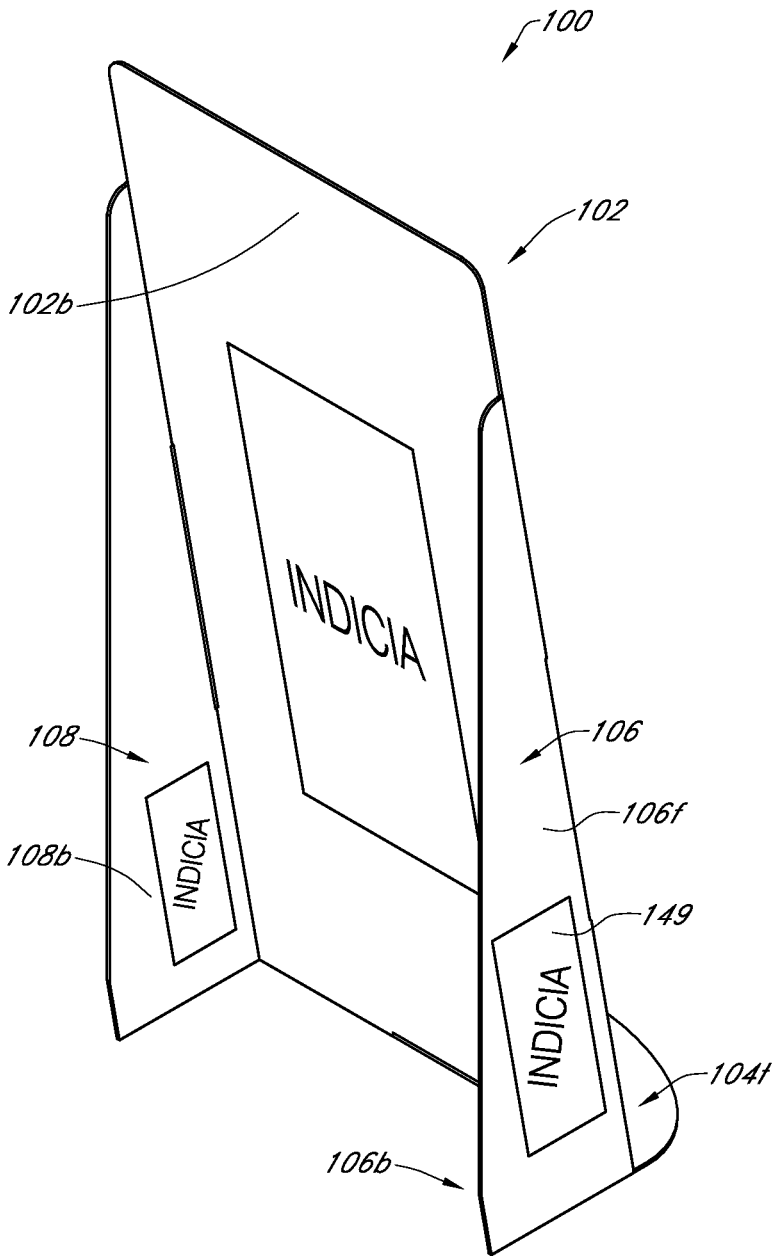
FIG. 4 shows another perspective view of the self-supporting sign of FIG. 3.
Figure 5:
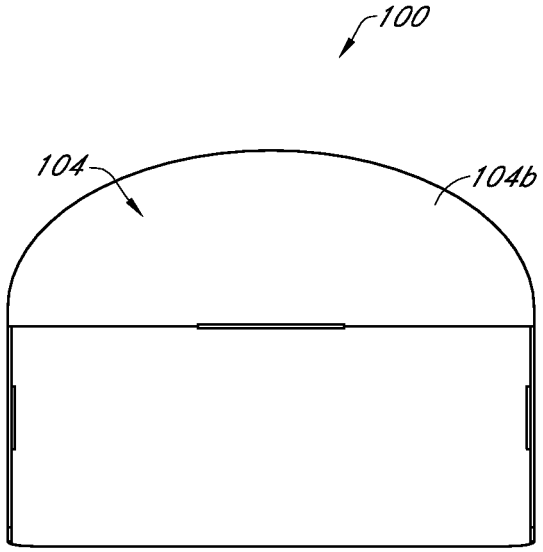
FIG. 5 shows a bottom view of the self-supporting sign of FIG. 3.
Figure 7:
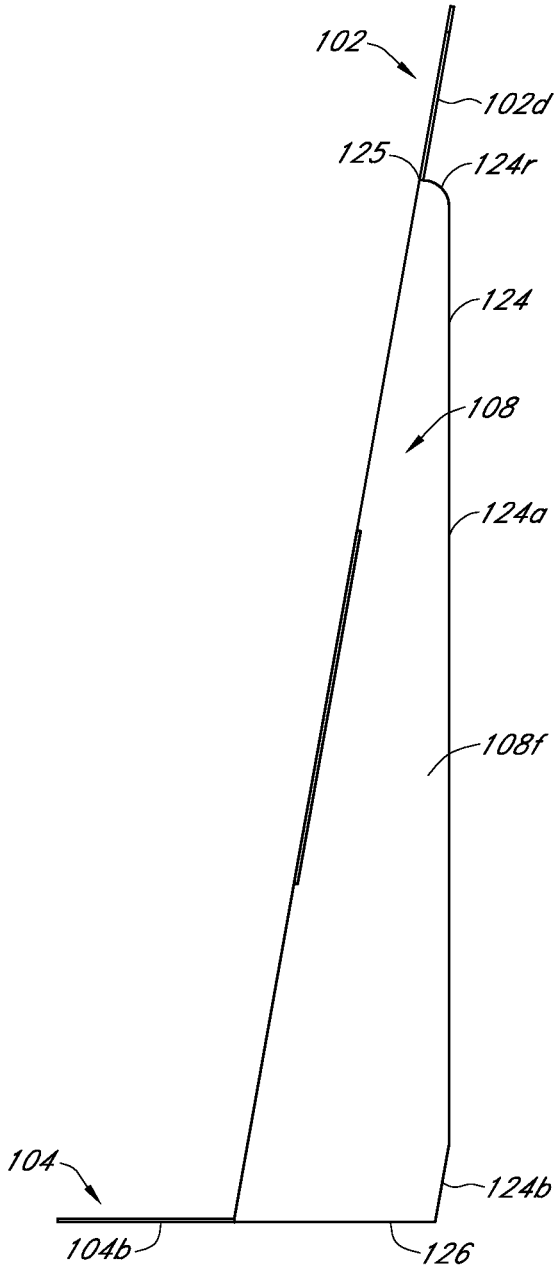
FIG. 7 shows a right side view of the self-supporting sign of FIG. 3.

FIG. 3 shows one embodiment 100 of a self-supporting sign in line with the teachings of the current invention. As can be seen, the sign 100 has a middle portion 102 having a front surface 102*f* and a back surface 102*b* (see FIG. 4), a front portion 104 having a top surface 104*t* and a bottom surface 104*b* (see FIG. 5), a first side portion (or "flap") 106 having a front surface 106*f* and a back surface 106*b* (see FIG. 4), and a second side portion (or "flap") 108 (see FIG. 4) having a front surface 108*f* (see FIG. 7) and a back surface 108*b*.

The middle portion 102 may be generally rectangular as shown, or of other regular or irregular shapes. The middle portion 102 may have an upper side 102*u*, a lower side 102*l*, a first side 102*c* and a second side 102*d*. A corner 110*a* formed at the intersection of the first side 102*c* and the upper side 102*u*, and a corner 110*b* formed at the intersection of the second side 102*d* and the upper side 102*u*, may both, in some embodiments, be rounded.

Figure 8:
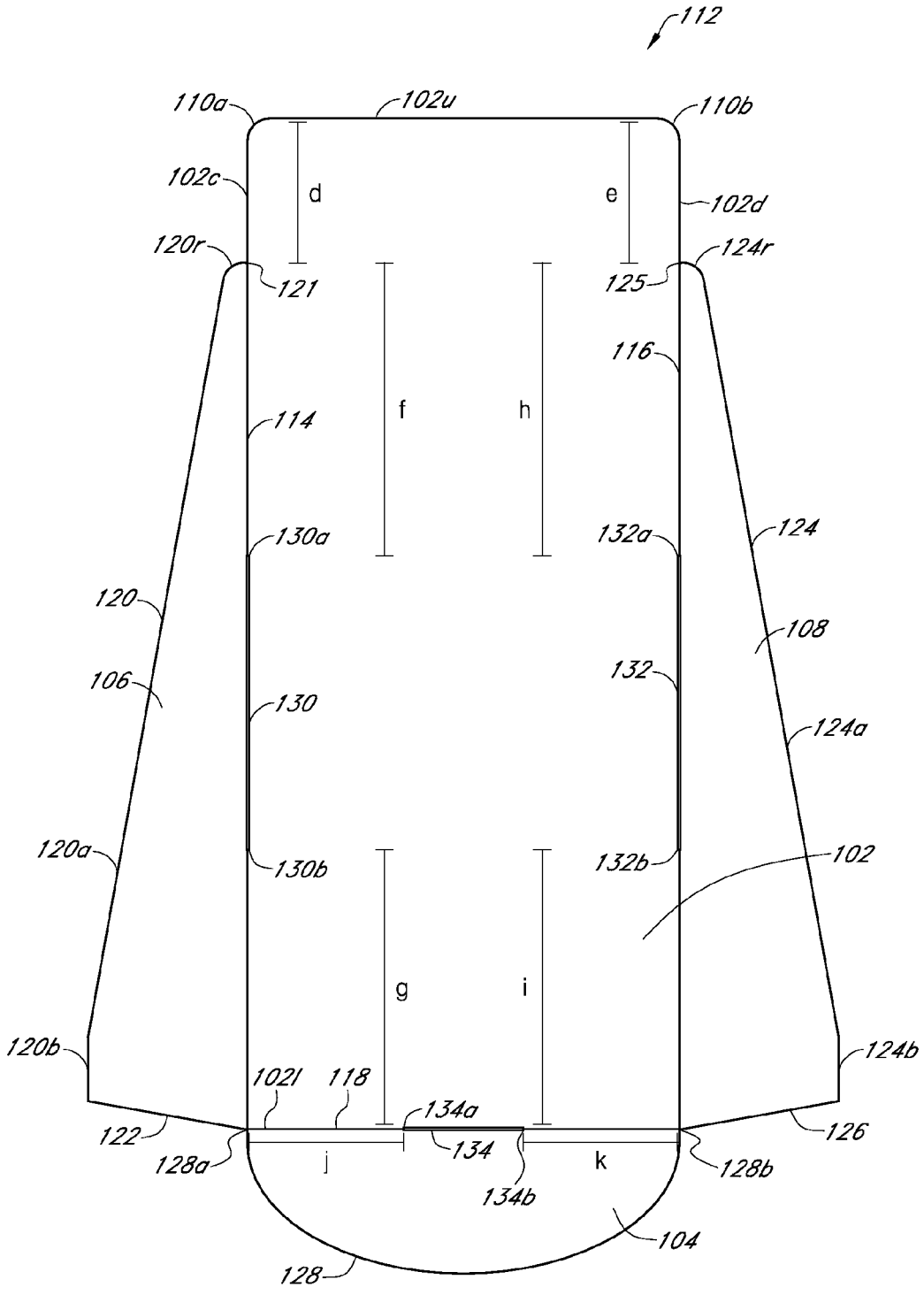
FIG. 8 shows a top view of the self-supporting sign of FIG. 3 before a first flap, a second flap, and a front portion are folded with respect to a middle portion.

The self-supporting sign 100 has a unitary construction of sheet 112 (see FIG. 8). The sheet 112 may have a first fold line 114 to distinguish the first side portion 106 from the middle portion 102, a second fold line 116 to distinguish the second side portion 108 from the middle portion 102, and a third fold line 118 to distinguish the front portion 104 from the middle portion 102. The first fold line 114 may be in line with and extend part of the length of the middle portion first side 102*c*, the second fold line 116 may be in line with and extend part of the length of the middle portion second side 102*d*, and the third fold line 118 may be in line with and extend the entire length of the middle portion lower side 102*l*.

Figure 6:
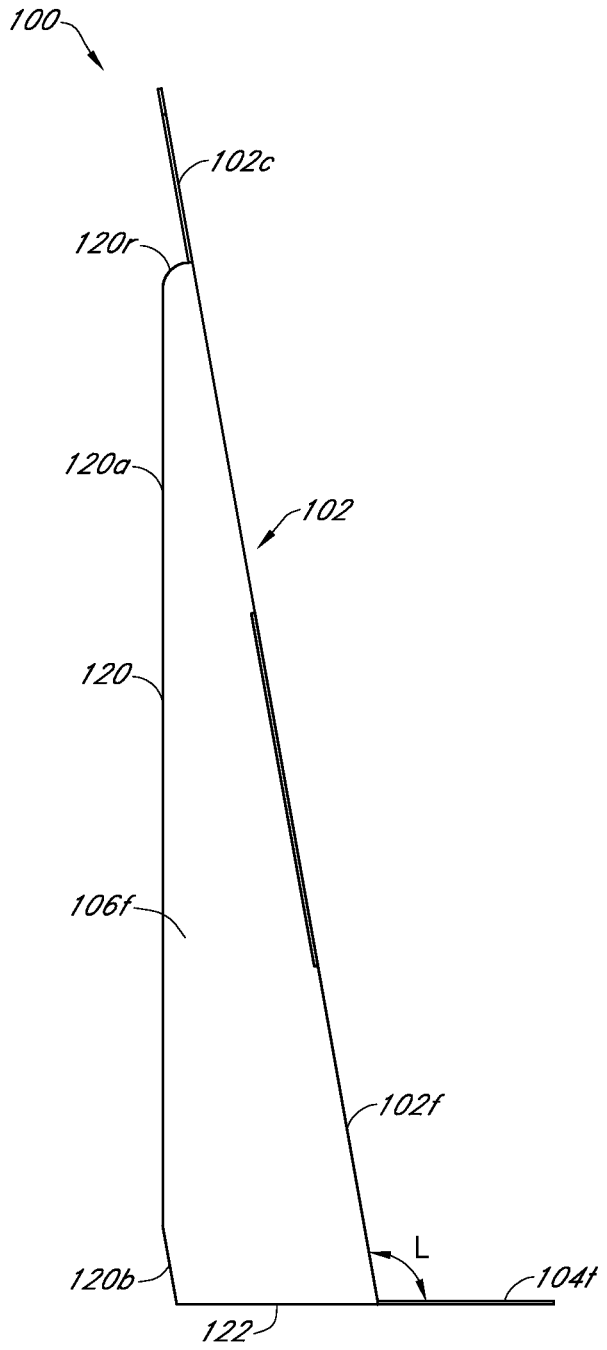
FIG. 6 shows a left side view of the self-supporting sign of FIG. 3.

The first flap 106 may have an outer edge 120 and a lower edge 122. The first flap outer edge 120 may have a rounded portion 120*r* having an end 121 adjacent the middle portion first side 102*c*. The rounded portion 120*r* may originate at the end 121, which, as shown in FIG. 8, may be a distance d beneath the middle portion upper side 102*u*. The first flap outer edge 120 may have a first angled portion 120*a* that extends outwards from the rounded portion 120*r* at an angle. The first flap outer edge 120 may also have a second angled portion 120*b* that extends slightly inwards from the first angled portion 120*a* (see FIG. 6) at an angle and terminates at the first flap lower edge 122. The first flap lower edge 122 may extend from the bottom of the second angled portion 120*b* to the bottom of the middle portion first side 102*c*.

The second flap 108 may similarly have an outer edge 124 and a lower edge 126. The second flap outer edge 124 may have a rounded portion 124*r* having an end 125 adjacent the middle portion second side 102*d*. The rounded portion 124*r* may originate at the end 125, which may be a distance e beneath the middle portion upper side 102*u*. The distances d and e may in some embodiments be equal. Akin to the first flap outer edge 120, the second flap outer edge 124 may have a first angled portion 124*a* that extends outwards from the rounded portion 124*r* at an angle. The second flap outer edge 124 may also have a second angled portion 124*b* that extends slightly inwards from the second flap first angled portion 124*a* (see FIG. 7) at an angle and terminates at the second flap lower edge 126. The second flap lower edge 126 may extend from the bottom of the second flap second angled portion 124*b* to the bottom of the middle portion second side 102*d*. In some embodiments, it may be particularly desirable for the first flap lower edge 122 to not be collinear with the middle portion lower side 102*l*, and for the second flap lower edge 126 to not be collinear with the middle portion lower side 102*l*. However, the lower edges 122, 126 may be offset relative to the middle portion lower side 102*l* by generally the same amount (e.g., five to twenty degrees).

The front portion 104 may extend from the lower side 102*l* of the middle portion 102. As can be seen in the figures, the front portion 104 may have a semi-oval shape, and have a generally rounded outer edge 128 having a first end 128*a* adjacent the middle portion first side 102*c* and a second end 128*b* adjacent the middle portion second side 102*d*.

A first slit 130 (see FIG. 8) having a first end 130*a* and a second end 130*b* may be cut out along the first fold line 114. While not required, a distance f between the first slit first end 130*a* and the first flap rounded portion end 121 may be generally equal to a distance g between the first slit second end 130*b* and the middle portion lower side 102*l*. A second slit 132 having a first end 132*a* and a second end 132*b* may be cut out along the second fold line 116. A distance h between the second slit 132 first end 132*a* and the second flap rounded portion end 125 may be generally equal to a distance i between the second slit second end 132*b* and the middle portion lower side 102*l*. At least in some embodiments, the distances f, g, h, and i may all be generally equal.

A third slit 134 having a first end 134*a* and a second end 134*b* may be cut out along the third fold line 118. A distance j between the third slit first end 134*a* and the first fold line 114 may, in some embodiments, be equal to a distance k between the third slit second end 134*b* and the second fold line 116.

Figure 9:
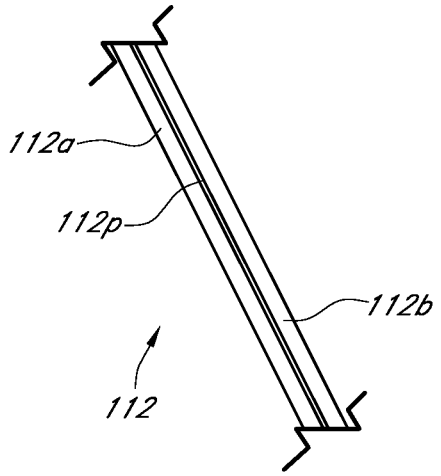
FIG. 9 shows a cross sectional view of a portion of the self-supporting sign of FIG. 3.

As shown in FIG. 9, the sheet 112 may include a primary layer 112*p*, a first laminate layer 112*a*, and a second laminate layer 112*b*, such that the primary layer 112*p* is located between the laminate layers 112*a*, 112*b*. The primary layer 112*p* may be, for example, a synthetic printing substrate (e.g., the product marketed under the name Teslin® by PPG industries of Monroeville, Pa.), another printing substrate, or any other appropriate foldable material (e.g., plastics, paper, et cetera). The laminate layers 112*a*, 112*b* may be, for example, 10 mil gloss laminate, or any other appropriate laminating material. Importantly, the primary layer 112*p* and the laminate layer(s) 112*a*, 112*b* must collectively be sufficiently rigid such that the middle portion 102 and the flaps 106, 108 remain in a raised position upon folding, as discussed in more detail below. Though not shown in the figures, it may also be acceptable for multiple laminate layers 112*a*, 112*b* to be used on either or both sides of the primary layer 112*p* (e.g., such that sheet 112 two laminate layers 112*a* coupled atop one another), and for multiple primary layers 112*p* to be included (e.g., adhered to one another). Especially if laminate layers 112*a*, 112*b* are included, it may be desirable for indicia to be placed on the primary layer 112*p* (e.g., using a digital press, cold fusion printing, or any other appropriate method) before the laminate layers 112*a*, 112*b* are adhered to the primary layer 112*p*.

Figure 10:
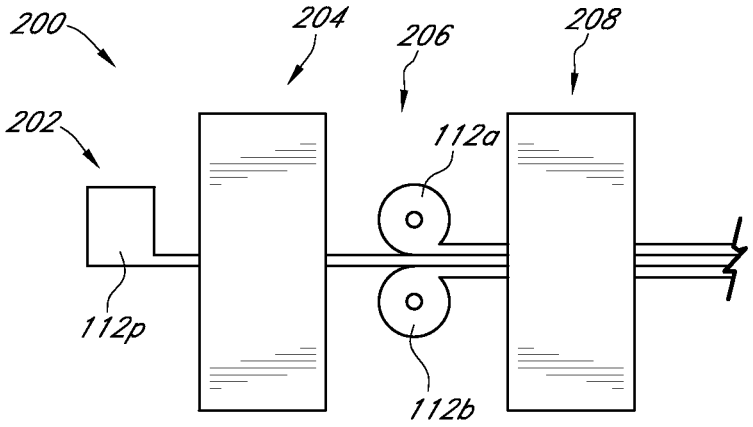
FIG. 10 shows a schematic representation of a manufacturing process for the self-supporting sign of FIG. 3.

FIG. 10 shows a schematic representation of a manufacturing process 200 for the self-supporting sign 100. At a first step 202, the primary layer 112*p* is provided (e.g., as a sheet or roll). The process 200 proceeds from step 202 to step 204.

At step 204, indicia is added to the primary layer 112*p* (i.e., to one side or both sides of the primary layer 112*p*), such as through a digital press or any other appropriate method. It may be particularly important for any desired indicia to be added before the primary layer 112*p* is coupled to the laminate layers 112*a*, 112*b*, though indicia may be added in some embodiments after the primary layer 112*p* is coupled to the laminate layers 112*a*, 112*b*. The process 200 proceeds from step 204 to step 206.

At step 206, the laminate layers 112*a*, 112*b* are coupled to the opposite sides of the primary layer 112*p*, such as by pressure sensitive adhesive. The laminate layers 112*a*, 112*b* may be obtained already having pressure sensitive adhesive, or pressure sensitive adhesive may otherwise be applied to the primary layer 112*p* and/or the laminate layers 112*a*, 112*b*. Though the adhesive is not shown in the drawings, those skilled in the art will appreciate that it is present nevertheless. The process 200 proceeds from step 206 to step 208.

At step 208, the primary layer 112*p* and the laminate layers 112*a*, 112*b* are die cut, defining the self-supporting sign 100 (i.e., its perimeter and also the slits 130, 132, and 134). Simultaneously, or in a further step, the first, second, and third fold lines 114, 116, and 118, respectively, may be defined through pressure that does not cut through the sheet 112. In some embodiments, the fold lines 114, 116, 118 may not be defined through the manufacturing process.

To use the self-supporting sign 100 (i.e., in a "use configuration"), first flap 106 may be folded along the first fold line 114 such that the back surface 106*b* of the first flap 106 and the back surface 102*b* of the middle portion 102 are generally perpendicular to each other. The second flap 108 may similarly be folded along the second fold line 116 such that the back surface 108*b* of the second flap 108 and the back surface 102*b* of the middle portion 102 are generally perpendicular to each other, and the back surfaces 106*b*, 108*b* of the first and second flaps 106, 108 face each other. Either before or after the flaps 106, 108 are so folded, the front portion 104 may be folded along the third fold line 118 such that an obtuse angle L (see FIG. 6) is formed between the front portion top surface 104*t* and the middle portion front surface 102*f*. The angle L may be, for example, between 100 degrees and 150 degrees. It has been found that the first, second, and third slits 130, 132, and 134 significantly increase the ease with which the first flap 106, the second flap 108, and the top portion 104, respectively, can be folded in their proper positions with respect to the middle portion 102. People of skill in the art will appreciate that the first, second, and third slits 130, 132, 134 have been exaggerated in the figures for illustrative purposes, and that these slits 130, 132 and 134 may not be readily apparent or detract from the appearance of a folded sign 100.

The sign 100 may then be stood upright on the ground or another surface (e.g., a table, a counter, et cetera) such that at least part of the lower edge 122 of the first flap 106, the lower edge of the 126 of the second flap 108, and the bottom surface 104*b* of the front portion 104 are in contact with the surface. Notably, the flaps 106, 108 do not lock into (or otherwise directly interact with) any portion apart from the middle portion 102. The first flap second angled portion 120*b* and the second flap second angled portion 124*b* may provide structural integrity and also help the sign 100 to remain upright. As noted above, indicia (e.g., advertisements, special offers, et cetera) may be provided on the front and back surfaces 102*f*, 102*b*, of the middle portion 102, the front and back surfaces 106*f*, 106*b*, of the first flap 106, the front and back surfaces 108*f*, 108*b* of the second flap 108, and/or at least the top surface 104*t* of the front portion 104. For example, as shown in FIG. 3, indicia 147 may be provided at the front surface 102*f* (and/or the back surface 102*b*), indicia 148 may be provided at the top surface 104*t*, and indicia 149 may be provided at either surface (or both surfaces) of the flaps 106, 108.

Figure 11:
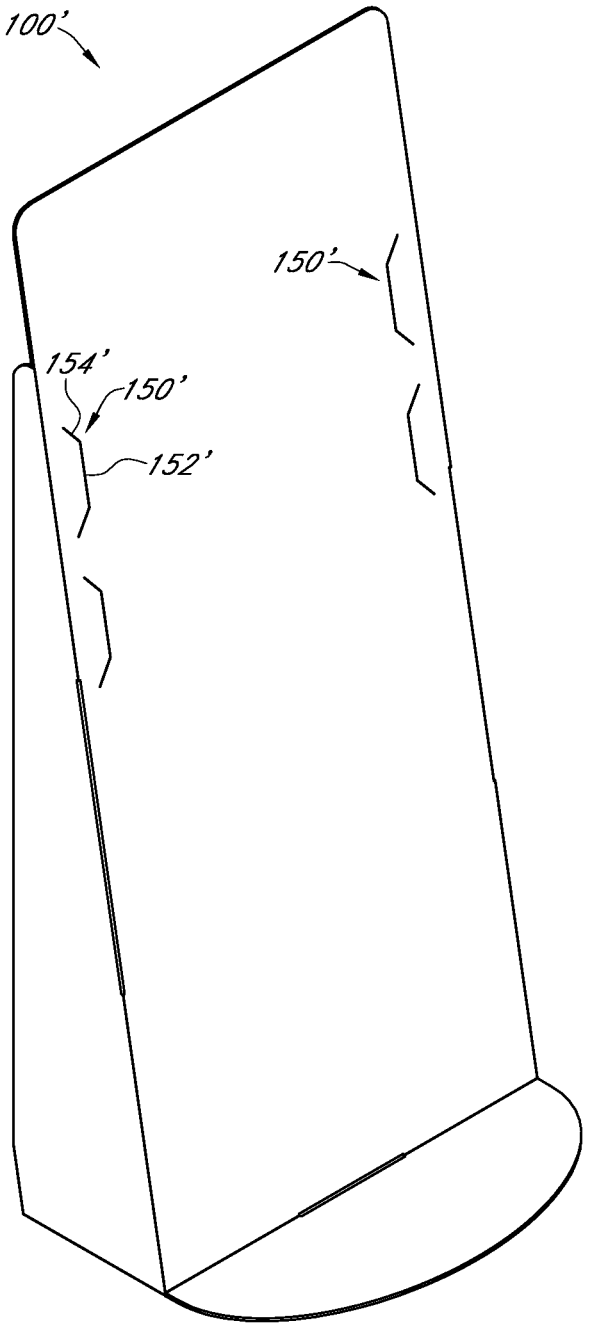
FIG. 11 shows a perspective view of another embodiment of the self-supporting sign of FIG. 3.

FIG. 11 shows an alternate embodiment 100' of the sign 100 that is substantially similar to the embodiment 100, except as specifically noted and/or shown, or as would be inherent. Further, those skilled in the art will appreciate that the embodiment 100 (and thus the embodiment 100') may be modified in various ways, such as through incorporating all or part of the disclosure provided herein. For uniformity and brevity, corresponding reference numbers may be used to indicate corresponding parts, though with any noted deviations. The main difference between the sign 100' and the sign 100 is that the sign 100' may include one or more pairs of opposed retaining members 150' on the front surface 102*f* (and/or the back surface 102*b* of the middle portion 102, and/or the front or back surfaces 106*f*, 106*b*, 108*f*, 108*b* of the first flap 106 and the second flap 108, respectively). The retaining members 150' may allow for a business card, flyer, advertisement, coupon, invitation, memo, announcement, pad of paper, or other item to be coupled to the sign 100 by being held between one or both of the retaining members 150'. The retaining members 150' may for example be formed through a die cutting process (either at step 208 or another step) and may have a generally vertical portion 152' leading to angled portions 154' (as shown), or may be other shapes that allow the retaining function to be accomplished. Retaining members 150' may also or alternatively be provided on the top surface 104*t* of the front portion 104.

Thus, as has been described, the unique configuration and distinctive appearance of the self-supporting sign 100 makes it a prime vehicle for placing advertisements and other indicia, and minimizes the costs of materials associated with creating pop-up signs.

Figure 12:
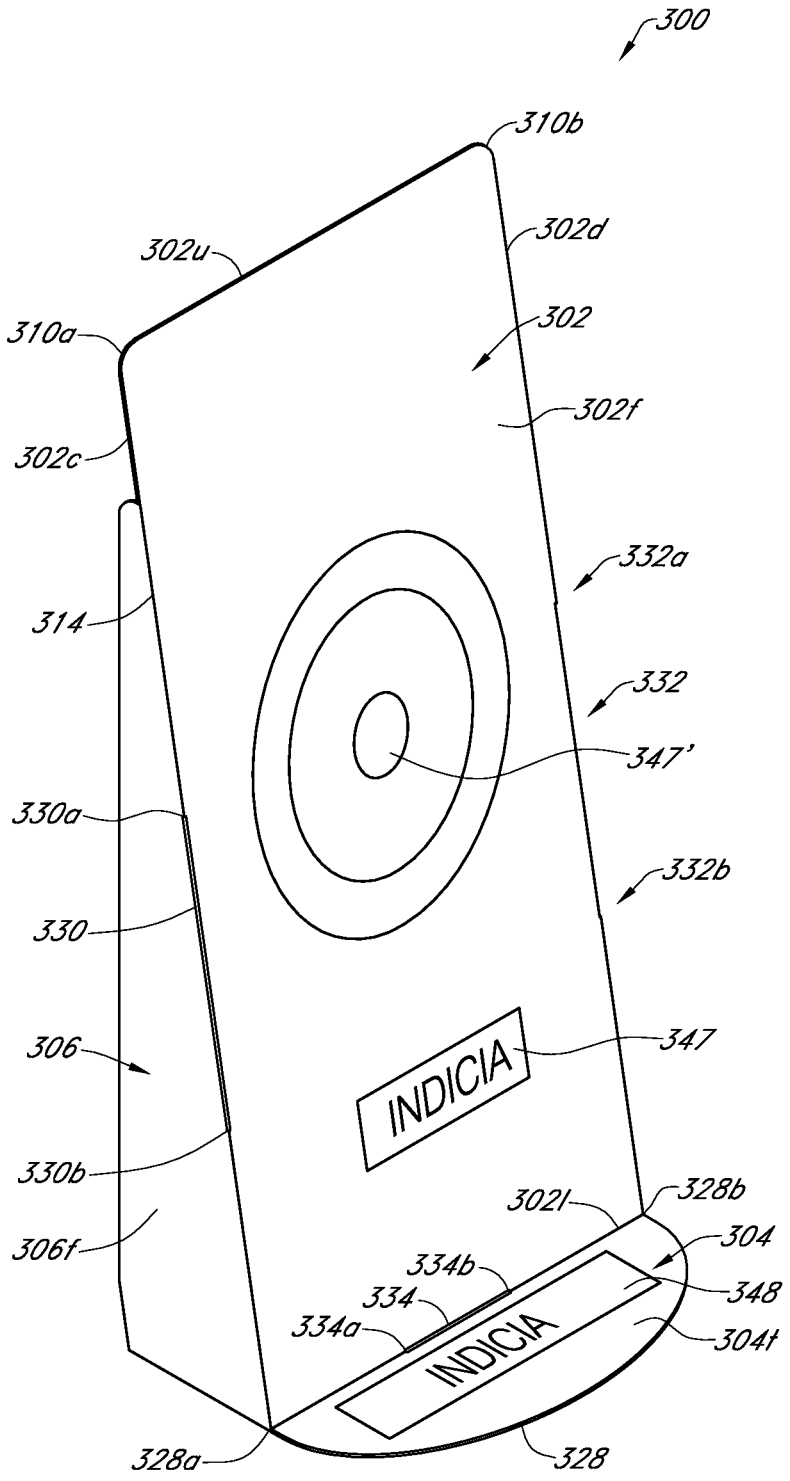
FIGS. 12 and 13 show perspective views of the self-supporting sign of FIG. 3 being configured for use as a target.
Figure 13:
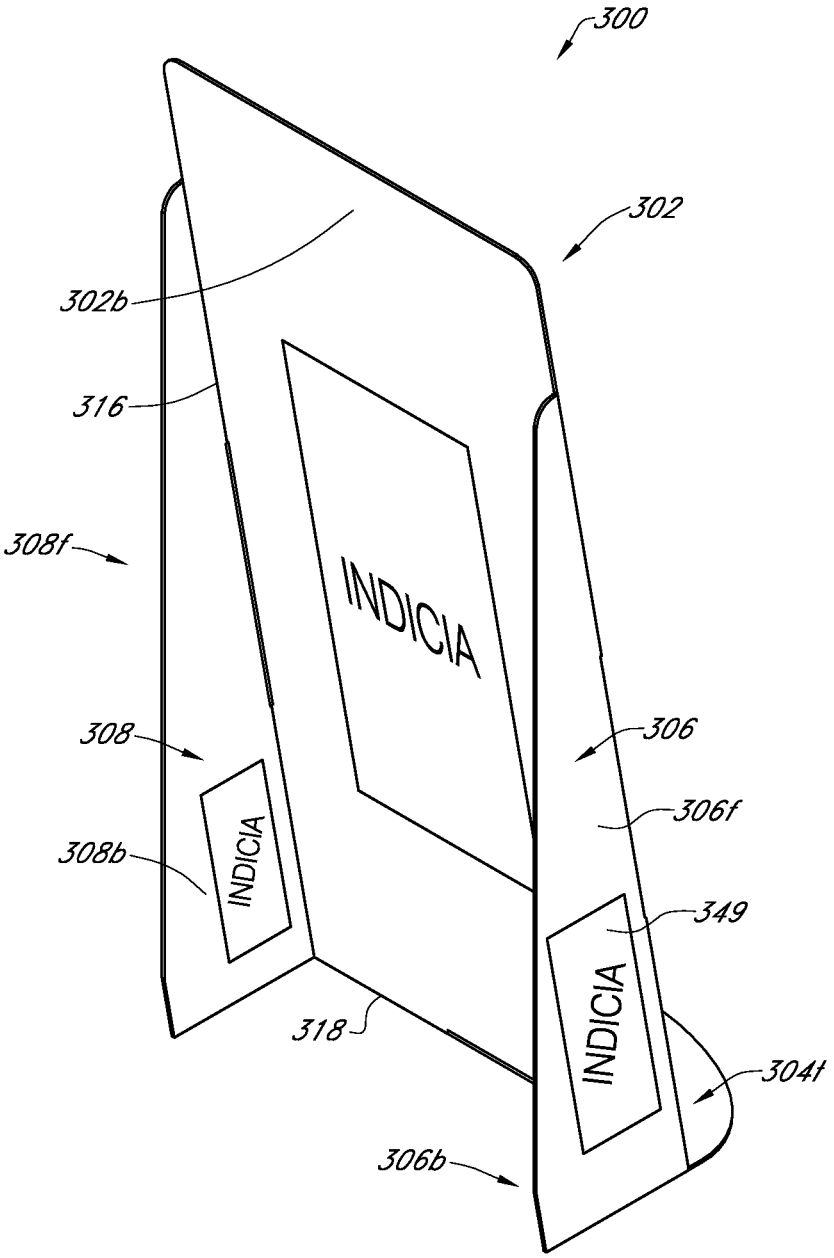
Figure 14:
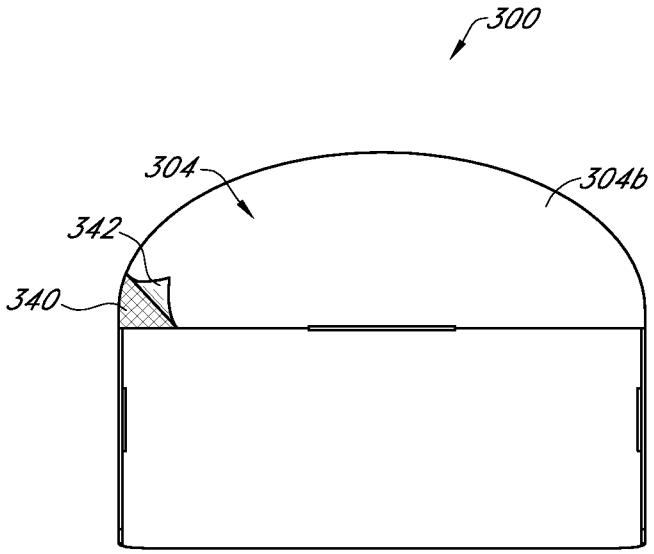
FIG. 14 shows a bottom view of the target of FIGS. 12 and 13.

The self-supporting sign 100 is versatile and may be used, in addition to or as opposed to a sign, as a target (e.g., for target practice, for competition shooting with guns or arrows, et cetera). Attention is directed now to FIGS. 12-14, which show a target 300 according to an embodiment of the present invention.

The target 300 is substantially similar to the sign 100 shown in FIG. 3, except as specifically noted and/or shown, or as would be inherent. Further, those skilled in the art will appreciate that the embodiment 100 (and thus the embodiment 300) may be modified in various ways, such as through incorporating all or part of the disclosure provided herein. For uniformity and brevity, corresponding reference numbers may be used to indicate corresponding parts, though with any noted deviations.

As noted above, the sign 100 has a middle portion 102 having a front surface 102*f* and a back surface 102*b* (see FIG. 4), a front portion 104 having a top surface 104*t* and a bottom surface 104*b* (see FIG. 5), a first side portion (or "flap") 106 having a front surface 106*f* and a back surface 106*b* (see FIG. 4), and a second side portion (or "flap") 108 (see FIG. 4) having a front surface 108*f* (see FIG. 7) and a back surface 108*b*. The target 300, much like the sign 100, has a middle portion 302 having a front surface 302*f* and a back surface 302*b* (see FIG. 13), a front portion 304 having a top surface 304*t* and a bottom surface 304*b* (see FIG. 14), a first side portion (or flap) 306 having a front surface 306*f* and a back surface 306*b* (see FIG. 13), and a second side portion (or flap) 308 (see FIG. 13) having a front surface 308*f* and a back surface 308*b*. Further, the sign 300 may also (but need not necessarily) have a slits 330, 332, and 334, which may generally correspond to the slits 130, 132, and 134 of the sign 100, respectively. Ends 330*a*, 330*b* of the slit 330, ends 332*a*, 332*b* of the slit 332, and ends 334*a*, 334*b* of the slit 334 may similarly generally correspond to the ends 130*a*, 130*b* of the slit 130, ends 132*a*, 132*b* of the slit 132, and ends 134*a*, 134*b* of the slit 134, respectively. As discussed above for the sign 100, where present, the slits 330, 332, and 334 may respectively facilitate the folding of the first flap 330, the second flap 332, and the front portion 304 with respect to the middle portion 302 in a use configuration.

The middle portion 302 may be generally rectangular as shown, or of other regular or irregular shapes. The middle portion 302 may have an upper side 302*u*, a lower side 302*l*, a first side 302*c* and a second side 302*d*. A corner 310*a* formed at the intersection of the first side 302*c* and the upper side 302*u*, and a corner 310*b* formed at the intersection of the second side 302*d* and the upper side 302*u*, may both, in some embodiments, be rounded. The first side 302*c* and the second side 302*d* may respectively terminate at ends 328*a* and 328*b*.

The front portion 304 may extend from the lower side 302*l* of the middle portion 302, and may, in embodiments, have a semi-oval shape and a generally rounded outer edge 328. The rounded outer edge 328 may terminate at the ends 328*a*, 328*b*.

As noted above, the sign 100 may have indicia 147, 148, and 149. The target 300 may similarly have sign indicia 347 on the front surface 302*f* of the middle portion 302, sign indicia 348 on the top surface 304*t* of the front portion 304, and sign indicia 349 on the surfaces (e.g., 306*f*, 308*f*) of the flaps 306, 308. Unlike the sign 100, however, the target 300 may also have on the front surface 302*f* of the middle portion 302 target indicia 347'. The target indicia 347' may comprise, for example, concentric circles, image(s) of an animal (e.g., a squirrel, a deer, et cetera) or person (e.g., a terrorist, a zombie), or any other indicia commonly used for targets.

Another difference between the sign 100 and the target 300 may be that the bottom surface 304*b* of the front portion 304 may comprise adhesive 340 (e.g., a pressure sensitive adhesive or another suitable adhesive) (see FIG. 14). In some embodiments, a releasable liner 342 may be situated atop the adhesive 340 to ensure that the adhesive 340 does not come into contact with a surface inadvertently.

The target 300 is very versatile in that in embodiments it may be used as both a sign and a target. For example, during a competition shooting event, the target 300 may first be used as a sign to convey information; that is, one or more of the sign indicia 347, 348, and 349 may be utilized to advertise ammunition, guns, hunting equipment, or to provide other information as is commonly done using signs. As discussed in more detail above with respect to the sign 100, the target 300 makes for a self-supporting sign (i.e., can be stood upright once the flaps 330, 332, and the front portion 304 are conveniently folded along their respective fold lines 314, 316, and 318 to put the target 300 in a use configuration). Once the shooting is set to commence, the release liner 342 may be removed to expose the adhesive 340, and the target 300 (specifically, the bottom surface 304*b* of the front portion 304) may be secured to a surface (e.g., a table, the floor, et cetera) so that it may be used as a target. It will be appreciated that the adhesive 340 may render the target 300 less likely to be displaced from its original position once a projectile (e.g., a bullet, an arrow, et cetera) passes therethrough or otherwise strikes the target 300. The fact that the target 300 may be used as a sign and as a target may provide significant cost savings (e.g., costs of material, printing, shipping, et cetera).

Figure 14A:
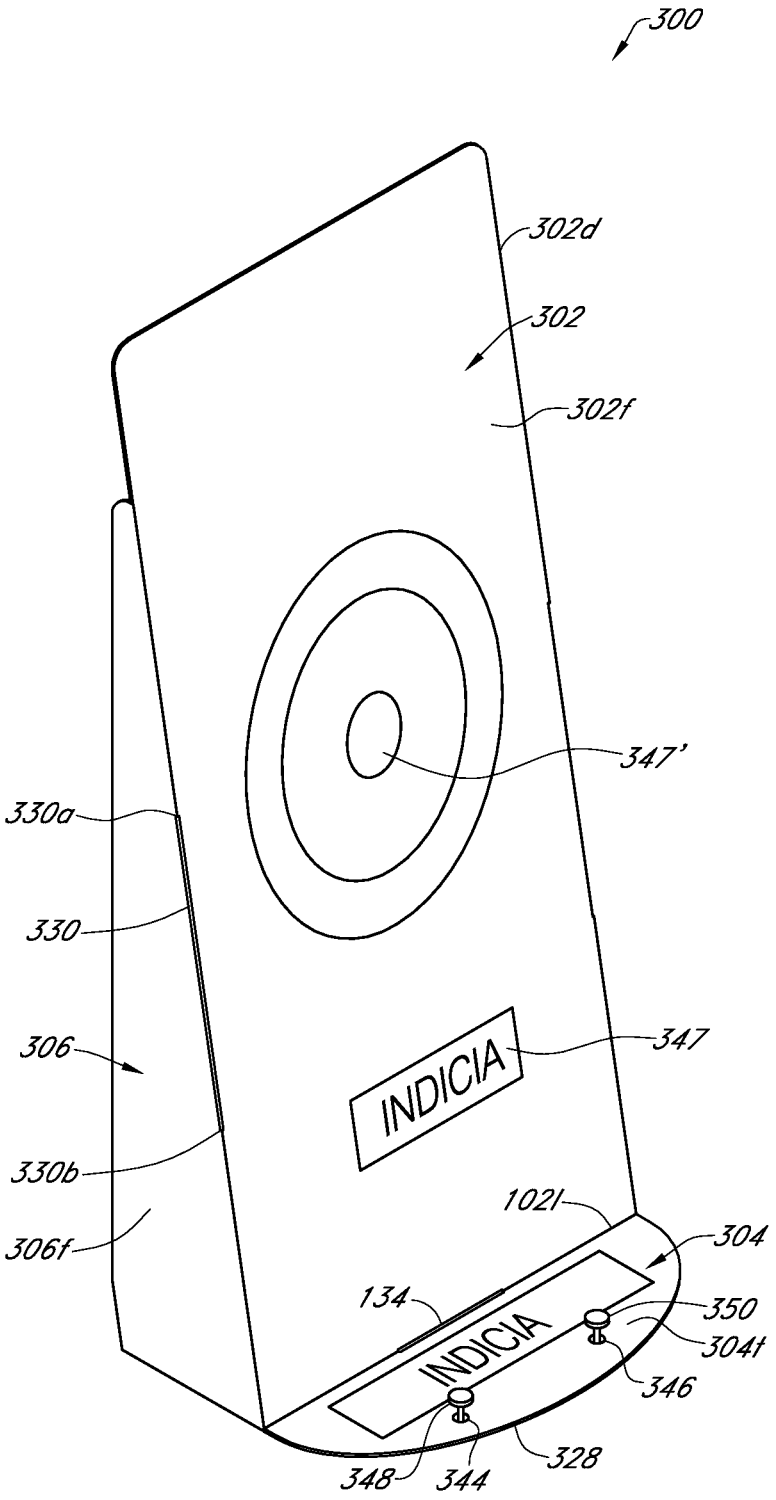
FIG. 14A shows a perspective view of another embodiment of the target of FIG. 12.

Attention is directed to FIG. 14A which shows another embodiment 300' of the target 300. The target 300' is generally identical to the target 300, except that the target 300' is devoid of the adhesive 340 and the liner 342 at the bottom surface 304*b* of the front portion 304. Instead, the target 300' has openings 344 and 346 that extend through the front portion 304. These openings 344, 346 may be configured for the passage of fastening members 348, 350 (e.g., nails, rods, et cetera) therethrough. More specifically, the opening 344 may be configured for the passage of the fastening member 348 and the opening 346 may be configured for the passage of the fastening member 350. These openings 344, 346 and fastening members 348, 350 may allow the target 300' to be secured to a surface (such as the ground, a floor, a table, et cetera) when the target 300' is to be used as a target. Of course, the target 300' may also be used as a sign that can be stood upright (without the use of the fastening members 348, 350). It will be appreciated by the skilled artisan that while the openings 344, 346 are illustrated in FIG. 14A as being circular, that they may take on other shapes. For example, in some embodiments, the openings 344, 346 may be shaped like an X (i.e., comprise two perpendicular, intersecting slits), or take on other regular or irregular shapes.

In some embodiments, the target 300, like the target 300', may also include the openings 344, 346 (in addition to the adhesive 340 on the underside 304*b* of the front portion 304) so that a user may effectuate the securement of the target 300 using the adhesive 340 or the fastening members 348, 350, as desired. Such functionality may allow a user to utilize the target 300 in varying environments. For instance, if the target 300 is to be secured to a desk, the adhesive 340 may be used to secure to target 300 thereto; and if the target 300 is to be secured to a surface where using the adhesive 340 is undesirable (e.g., uneven grassy ground), the fastening members 348, 350 may be passed through the openings 344, 346 to secure the target 300.

Figure 14B:
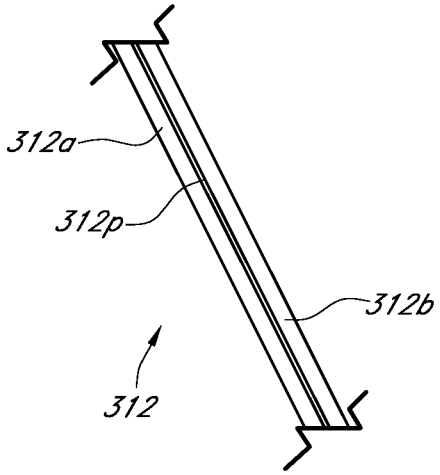
FIG. 14B shows a cross sectional view of a portion of the target of FIG. 12.

As noted above, the sign 100 may be manufactured using a unitary sheet 112. The targets 300 and 300' may be manufactured, in general, in the same way as the sign 100. For example, as shown in FIG. 14B, the targets 300, 300' may comprise a unitary sheet 312, which may include a primary layer 312*p*, a first laminate layer 312*a*, and a second laminate layer 312*b*. The primary layer 312P may be located between the laminate layers 312*a*, 312*b*. The primary layer 312*p* may be, for example, a synthetic printing substrate (e.g., the product marketed under the name Teslin® by PPG industries of Monroeville, Pa.), another printing substrate, or any other appropriate foldable material (e.g., plastics, paper, et cetera). The laminate layers 312*a*, 312*b* may be, for example, 10 mil gloss laminate, or any other appropriate laminating material. Importantly, the primary layer 312*p* and the laminate layer(s) 312*a*, 312*b* must collectively be sufficiently rigid such that the middle portion 302 and the flaps 306, 308 remain in a raised position upon folding when the target 300 is being used (e.g., as a sign). It may also be acceptable for multiple laminate layers 312*a*, 312*b* to be used on either or both sides of the primary layer 312*p*.

In some embodiments, the target indicia 347' and sign indicia 347, 348, and 349 may be placed on the primary layer 312*p* (e.g., using direct thermal printing, thermal transfer printing, cold fusion, or any other desirable means) before the laminate layers 312*a*, 312*b* are adhered to the primary layer 312*p*. In other embodiments, the target indicia 347' may be removable (e.g., the target indicia 347' may be placed on a label (such as a sticker) that can be removably adhered to the laminate layers 312*a* or 312*b*); in these embodiments, the target indicia 347' may be tailored to suit the needs of the particular application (e.g., the size of the target indicia 347' may be progressively reduced and/or altered as a target competition advances through the stages). It will be appreciated that FIGS. 12, 13, and 14 show the target 300 in a use configuration, and that in a storage configuration, the unitary sheet 312 forming the target 300 may generally appear as illustrated in FIG. 8. It will further be appreciated that in the use configuration, akin to the sign 100, the flaps 308, 308 may directly touch only the middle portion 302 and the surface on which the target 300' (or 300) rests.

Figure 15A:
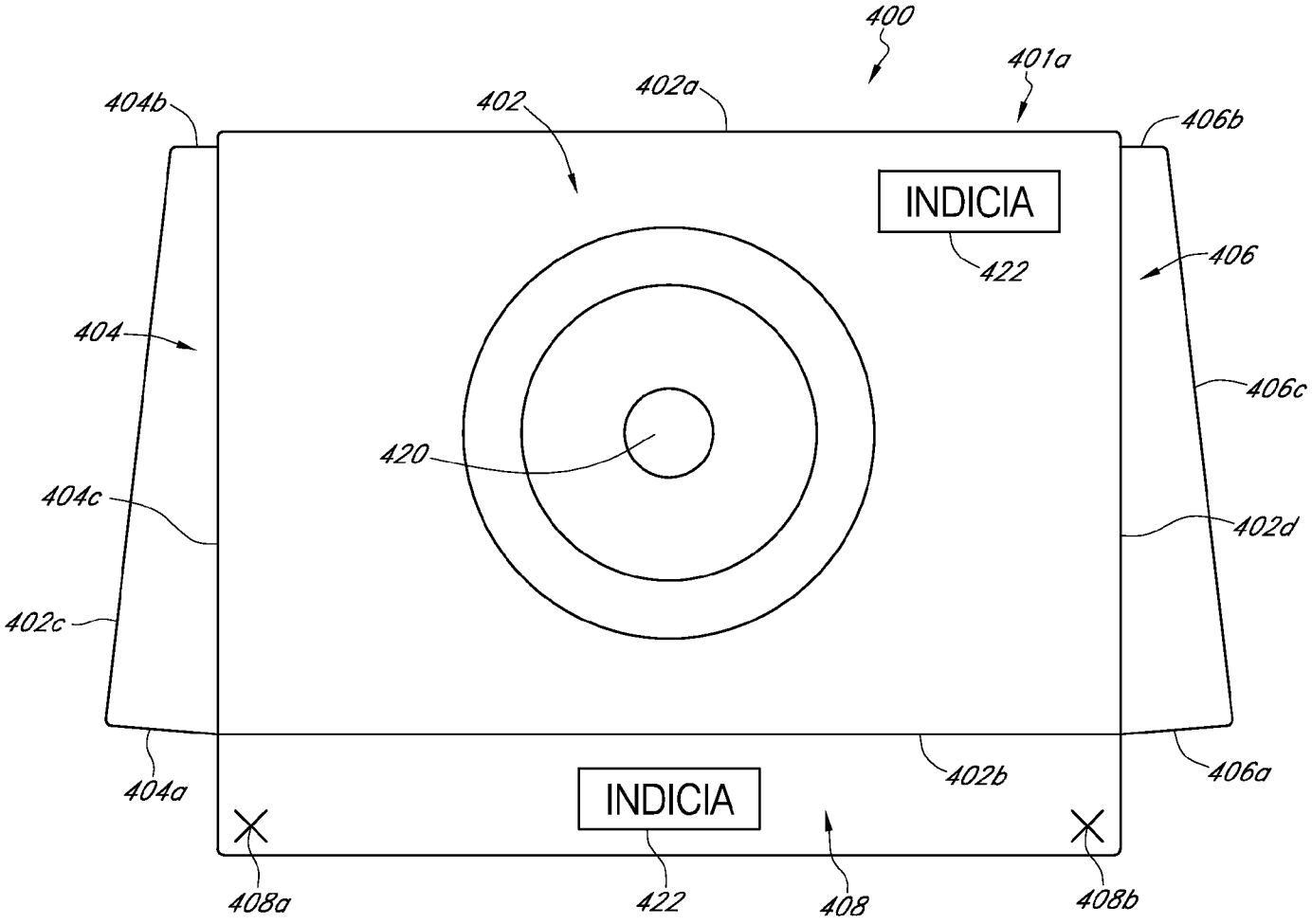
FIG. 15A shows a perspective view of another embodiment of the target of FIG. 12, in a storage configuration.
Figure 15B:
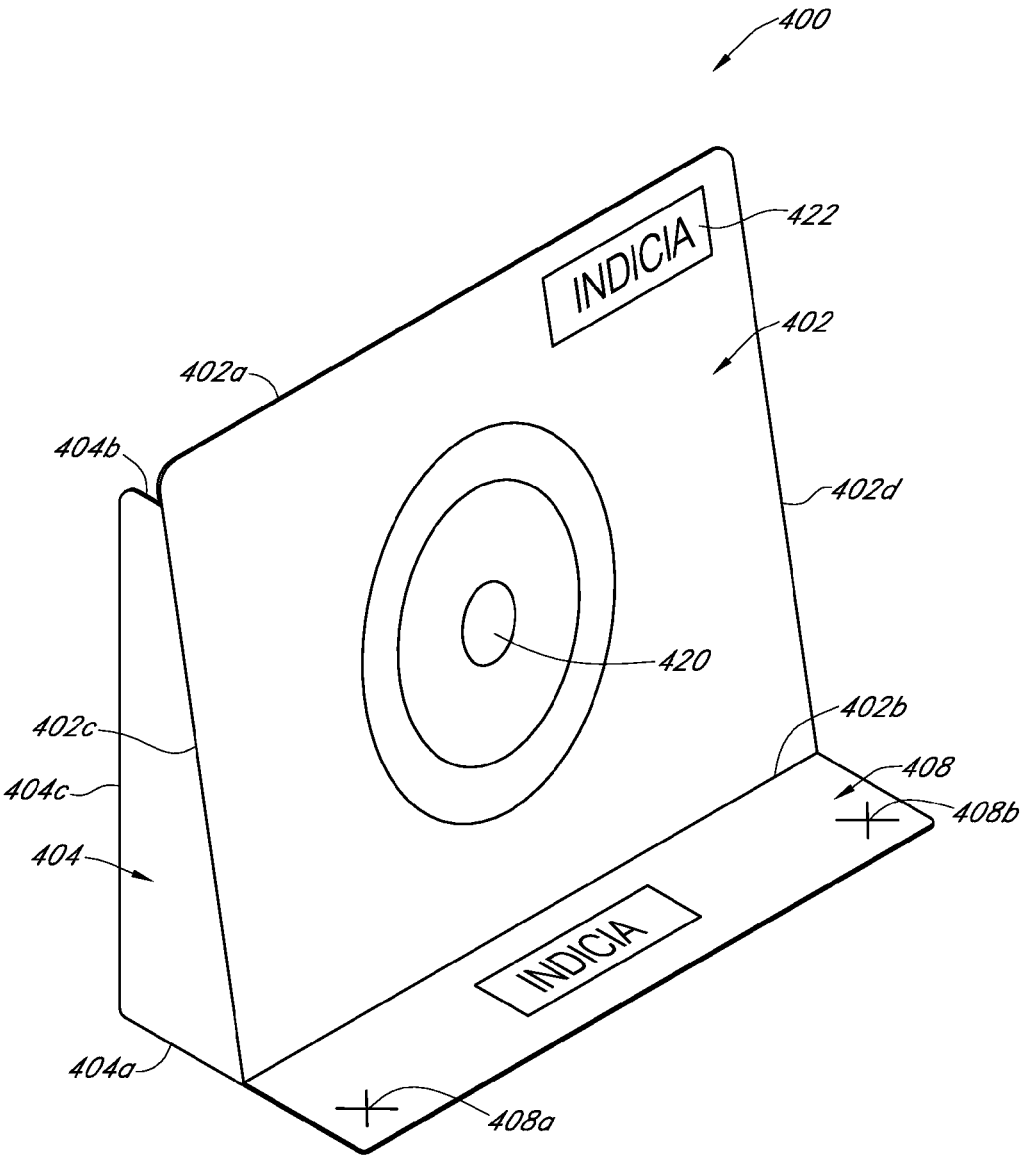
FIG. 15B shows a perspective view of the target of FIG. 15A in a use configuration.

Attention is directed now to FIG. 15A, which shows another embodiment 400 of the target 300. The target 400 may, like the target 300 and the sign 100, comprise a primary layer having first and second laminating layers laminated thereon. FIG. 15A shows the target 400 in a storage configuration 401A. FIG. 15B shows the target 400 in a use configuration 401B.

The target 400 may have a middle portion 402, a first flap 404, a second flap 406, and a front portion 408. The middle portion 402 may be generally rectangular as shown, or take on other regular or irregular shapes. The middle portion 402 may have a top edge 402A, a bottom edge 402B, a left edge 402C, and a right edge 402D. The first flap 404 may extend from the middle portion left edge 402C and the second flap 406 may extend from the middle portion right edge 406D. The front portion 408 may extend from the middle portion bottom edge 402B, as shown in FIG. 15A.

The first flap 404 may have a bottom edge 404A, a top edge 404B, and a side edge 404C. The second flap 406 may similarly have a bottom edge 406A, a top edge 406B, and a side edge 406C. A length of the top edge 404B may, in embodiments, be smaller than a length of the bottom edge 404A. A length of the top edge 406B may similarly, in embodiments, be smaller than the length of the bottom edge 406A. The lengths of the edges 404A, 406A, and of the edges 404B, 406B, may, in other embodiments, be generally equal. A height of the flaps 404, 406 may be less than a height of the middle portion 402 as shown; in other embodiments, however, the height of the flaps 404, 406 may be equal to or greater than the height of the middle portion 402.

The front portion 408 may be generally rectangular, or take on other regular or irregular shapes as desired. The front portion 408 may extend from the bottom edge 402B of the middle portion 402, and a length of the front portion 408 may be generally equal to a length of the middle portion 402. The front portion 408 may have openings 408A, 408B that extend therethrough to allow for the passage of fastening members (e.g., fastening members 348, 350). While the openings 408A, 408B are shown as being in the shape of a cross (specifically, two intersecting perpendicular slits), the skilled artisan will appreciate readily that the openings 408A, 408B may take on other shapes.

The flaps 404, 406 may be configured to be folded along the edges 402C, 402D, respectively, and the front portion 408 may be configured to be folded along the edge 402B, to place the target 400 in the use configuration 401B (FIG. 15B). In the use configuration 401B, the flaps 404, 406 may each form an angle with respect to the middle portion 402, which may, for example, be between 60 degrees and 120 degrees (e.g., 90 degrees). The front portion 408 may similarly form an angle with respect to the middle portion 402 in the use configuration 401B, which may, for example, be between 60 degrees and 120 degrees (e.g., 90 degrees). The middle portion 402, in the use configuration 401B, may form generally be perpendicular to the horizontal; however, it will be appreciated that the height of the flaps 404, 406 may be varied so that the middle portion 402 forms an obtuse angle (or an acute angle) with respect to the horizontal plane. Similarly, in embodiments, the flap bottom edges 404A, 406A may extend from the middle portion 402 at an angle to enable the middle portion 402 to make any desirable angle with the horizontal when the target 400 is in the use configuration 401B.

The target 400 may be self-supporting, i.e., may be placed in the use configuration 401B without additional elements or supports. Much like the target 300, the target 400 may (but need not) be used both as a sign and a target 400; for example, the middle portion 402 may have target indicia 420 and sign indicia 422, and the front portion 408 may have sign indicia 422. When the target 400 is being used as a target, fastening members 348, 350 (see FIG. 14A) may be passed through the openings 408A, 408B to secure the target 400 to a surface and ensure that the target 400 does not get uprooted by the force imparted on it by a projectile. Adhesive may alternatively, or additionally, be provided at the underside of the front portion 408 to enable the target 400 to be secured to a surface, as discussed above for the target 300.

Figure 16:
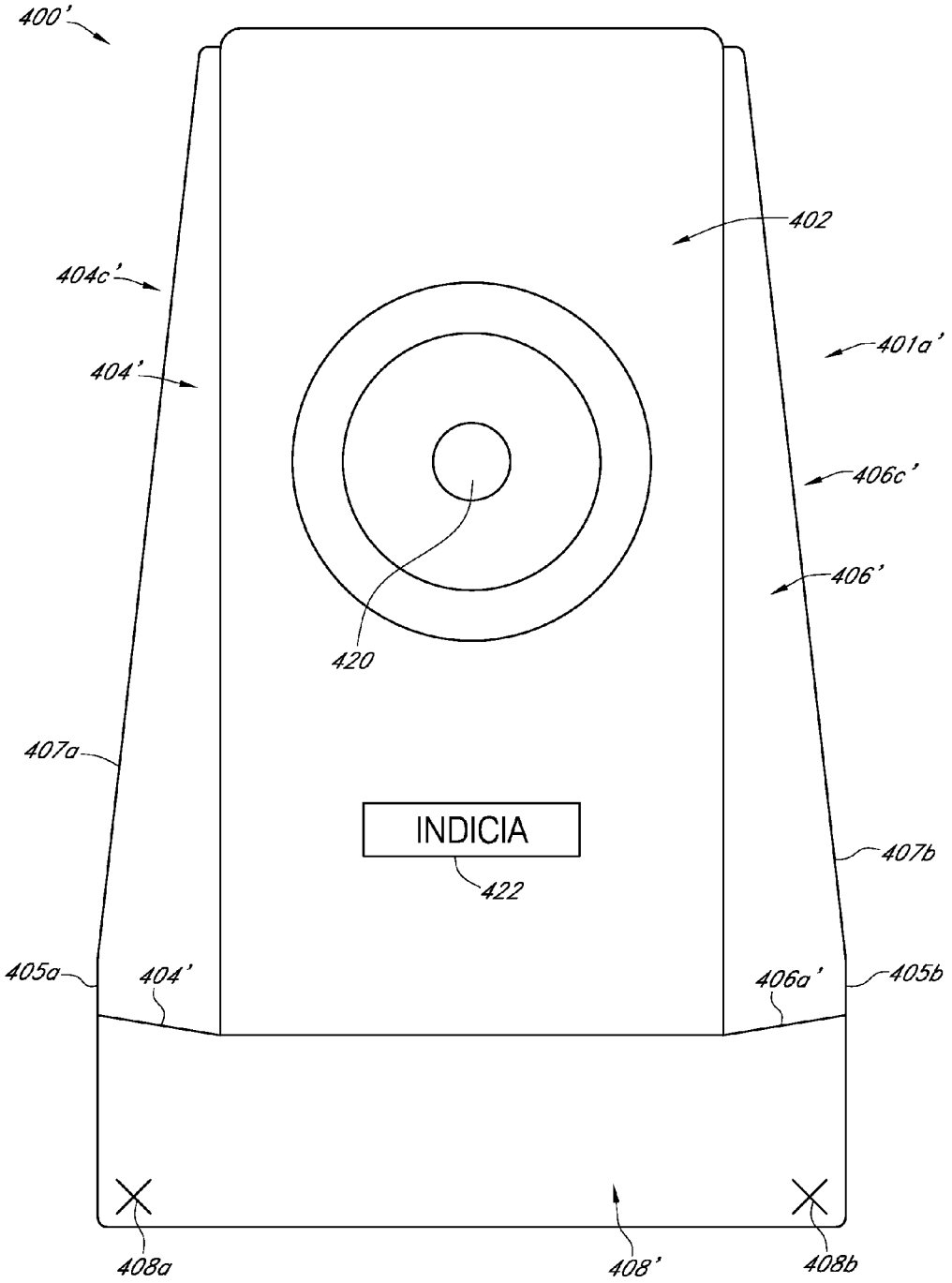
FIG. 16 shows a perspective view of another embodiment of the target of FIG. 15.

Attention is directed now to FIG. 16, which shows another embodiment 400' of the target 400. The target 400' is substantially similar to the embodiment 400, except as specifically noted and/or shown, or as would be inherent. Further, those skilled in the art will appreciate that the embodiment 400 (and thus the embodiment 400') may be modified in various ways, such as through incorporating all or part of the disclosure provided herein. For uniformity and brevity, corresponding reference numbers may be used to indicate corresponding parts, though with any noted deviations.

FIG. 16 shows the target 400' in a storage configuration 401A'. As can be seen, a length of the front portion 408' in this embodiment may be greater than a length of the middle portion 402B'. Further, in some embodiments, the bottom edges 404A' and 406A' of the flaps 404' and 406' may comprise perforations to allow the bottom edges 404A' and 406A' to be separated from the front portion 408' in the use configuration (not specifically shown).

The flaps 404, 406 of the target 400 may have side edges 404C and 406C, respectively, as discussed above. The flap 404' and 406' of the target 400' may have side edges 404C' and 406C'. The side edge 404C' may include a generally vertical portion 405A and an angled portion 407A that extends therefrom at an angle. The side edge 406C' may similarly include a generally vertical portion 405B and an angled portion 407B that extends from the vertical portion 405B at an angle. As will be appreciated, in the use configuration: the front portion 408' may be generally horizontal and be secured to a surface using fastening members (e.g., fastening members 348, 350) that are passed through the openings 408A, 408B; the middle portion 402 may form an angle with the horizontal which may range from between about 60 degrees to about 120 degrees; and, all or part of the flap bottom edges 404A' and 406A' may be in contact with surface and the flaps 404', 406' may each form an angle with respect to the middle portion 402 that is between about 60 degrees and 120 degrees. Of course, as discussed with respect to the embodiment 300, instead of or in addition to the openings 408A, 408B, adhesive (and a releasable liner) may be provided on the bottom surface (not specifically shown) of the front portion 408' to enable the target 400' to be secured to a surface when it is being used as a target.

Figure 17A:
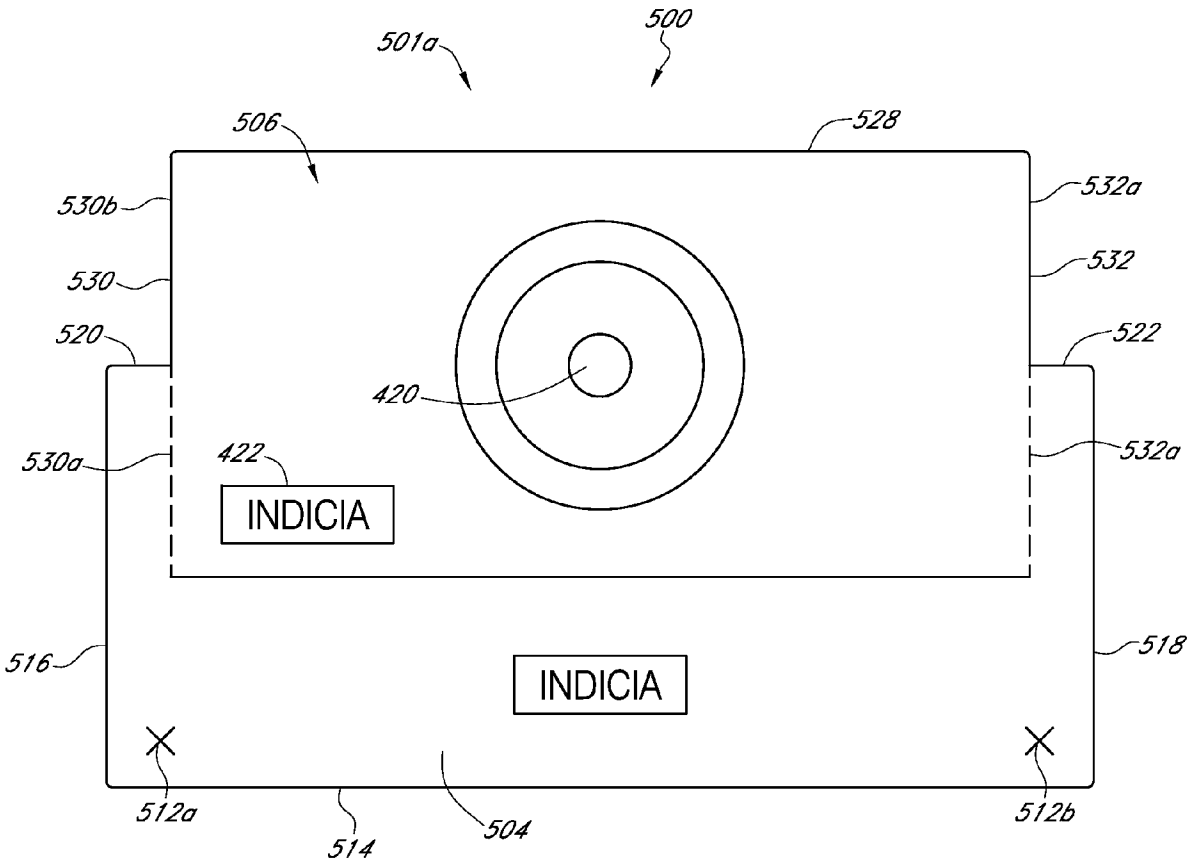
FIG. 17A shows a perspective view of another embodiment of the target of FIG. 15A.
Figure 17B:
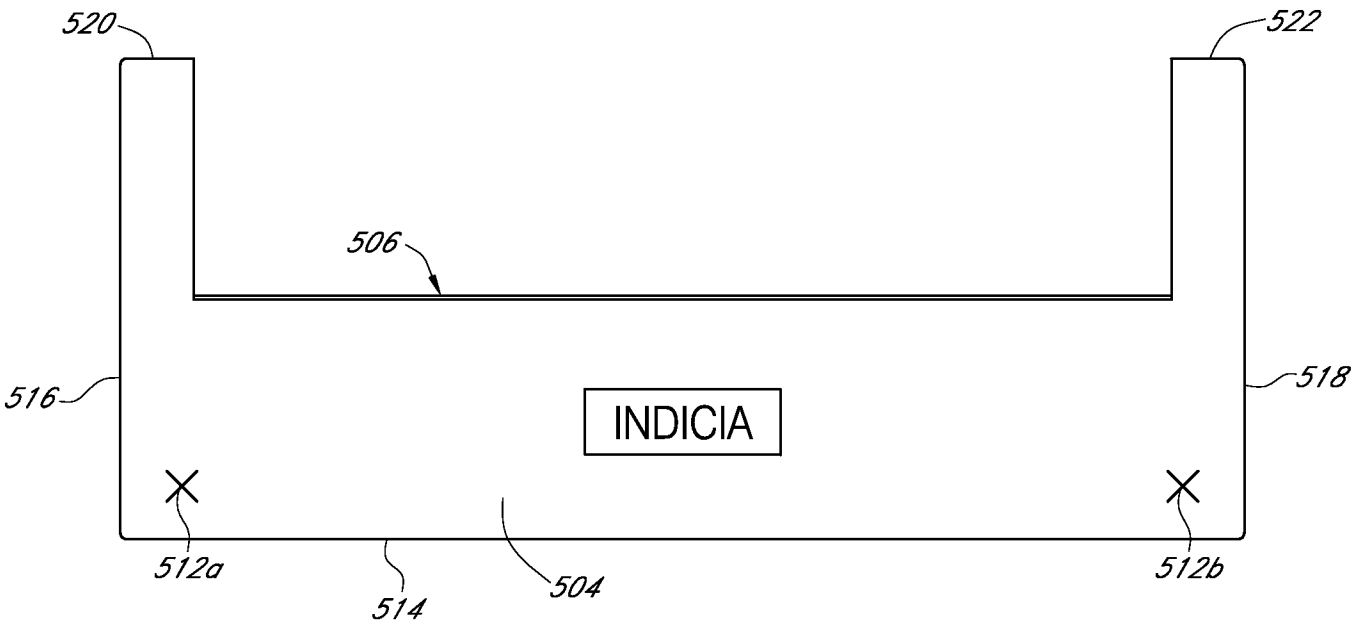
FIG. 17B shows a top view of the target of FIG. 17A.

FIGS. 17A and 17B show yet another target 500 in line with the teachings of the present invention. The target 500 is shown in a storage configuration 501A in FIG. 17A, and in a use configuration 501B in FIG. 17B. The target 500 may comprise a base portion 504 and a pop-out (or foldable) portion 506.

The base portion 504 may have a bottom edge 514, a left side edge 516, a right side edge 518, and top edges 520 and 522. A length of the top edges 520, 522 may be equal to each other, and a length of the bottom edge 514 may be greater than the length of each of the top edges 520, 522. The base portion 504 may comprise target indicia 420 and sign indicia 422.

The pop-out portion 506 may be generally rectangular as shown, or of other regular or irregular shapes. The pop-out portion 506 may have a bottom edge 524, a top edge 528, a left side edge 530, and a right side edge 532. These edges 524, 528, 530, and 532 may also be referred to herein as "borders." As can be seen, in an embodiment, the top and bottom edges 528, 524 of the pop-out portion 506 may be generally parallel to the bottom edge 514 of the base portion 504.

The left side edge 530 of the pop-out portion 506 may be parallel to and inwardly adjacent the left side edge 516 of the base portion 504. The left side edge 530 may extend from beneath the top edge 520 of the base portion 504 to past the top edge 520, as shown in FIG. 17A. More specifically, the left side edge 530 of the pop-out portion 506 may comprise a perforated portion 530A which may extend generally vertically from beneath the top edge 520 to the top edge 520, and a protruding portion 530B which may extend generally vertically from the top edge 520 away from the top edge 520 and the bottom edge 524.

Similarly, the right side edge 532 of the pop-out portion 506 may be parallel to and inwardly adjacent the right side edge 518 of the base portion 504. The right side edge 532 may extend from beneath the top edge 522 of the base portion 504 to past the top edge 520. More specifically, the right side edge 532 of the pop-out portion 506 may comprise a perforated portion 532A which may extend generally vertically from beneath the top edge 522 to the top edge 522, and a protruding portion 532B which may extend generally vertically from the top edge 522 away from the top edge 522 and the bottom edge 524. As can be seen, the left side edge 530 of the pop-out portion 506 may be proximate the left side edge 516 of the base portion 504 and distal the right side edge 518 of the base portion 504, and the right side edge 532 of the pop-out portion 506 may be proximate the right side edge 518 of the base portion 504 and distal the left side edge 516 of the base portion 504.

To place the target 500 in the use configuration 501B, the user may simply detach the perforated portions 530A, 530B of the pop-out portion 506 from the base portion 504 and fold the pop-out portion along the fold line (or bottom edge) 524. The target 500 (i.e., the primary and laminate layers forming the target 500) may be sufficiently rigid so as to allow the pop-out portion 506, once detached from the base portion 504 and folded along the fold line 524, to stand generally upright perpendicular to the horizontal base portion 504. In some embodiments, the perforated portions 530A, 532B may be absent, and the rectangular pop-out portion 506 may simply be joined to the base portion 504 only at the fold line 524.

In embodiments, the base portion 504 may include openings 512A, 512B, which may comprise holes or perpendicular slits, et cetera, so as to allow the base portion 504 to be secured to a table or other surface using fastening members (e.g., fastening members 348, 350). In other embodiments, as discussed above for the target 300, the base portion 504 may at its underside include adhesive and a release liner to allow for the base portion 504 be secured to a surface. The base portion 504 may in embodiments include sign indicia 422.

Figure 18:
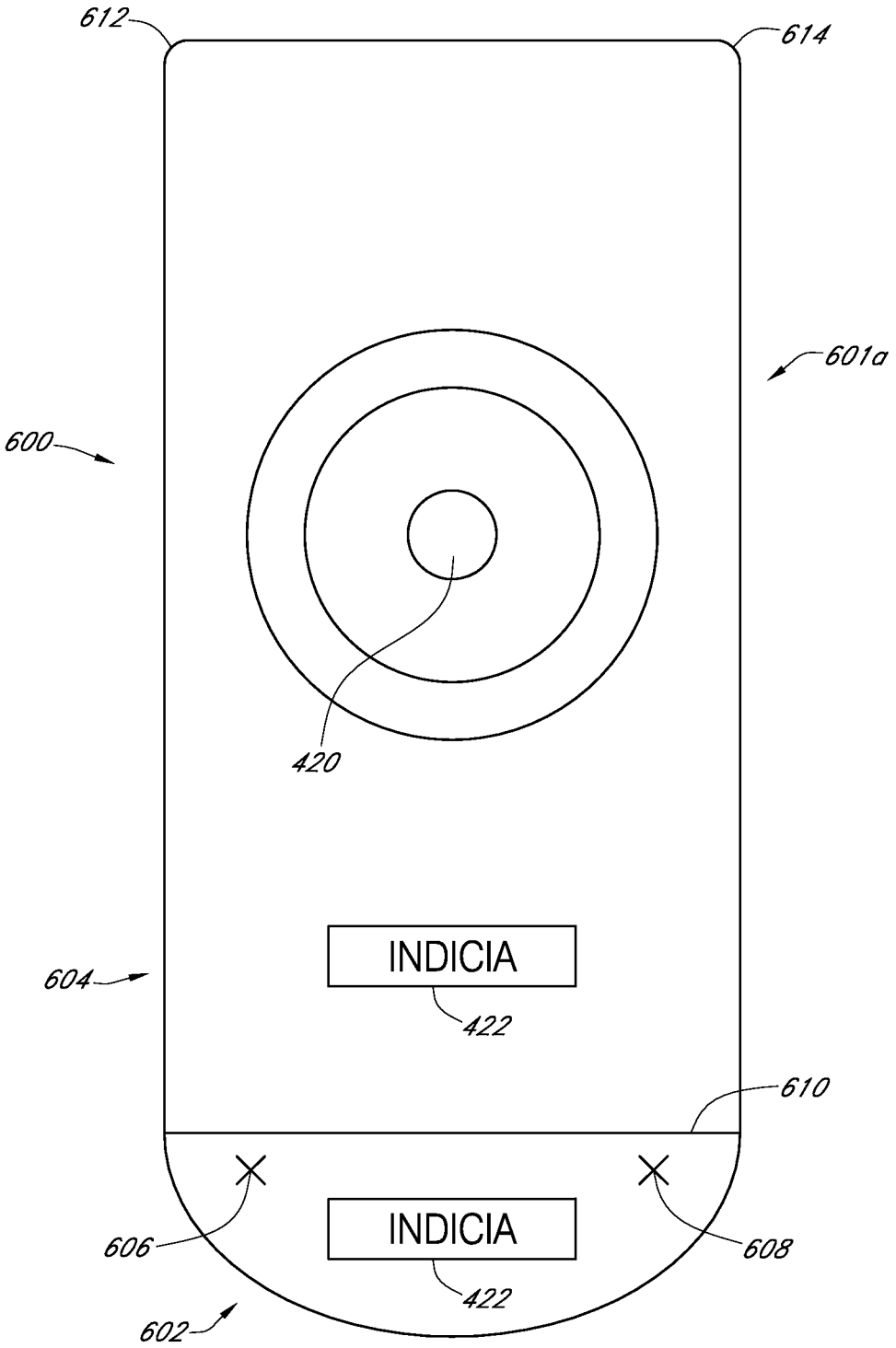
FIG. 18 shows a perspective view of yet another embodiment of the target of FIG. 15.

Focus is directed now to FIG. 18, which shows yet another embodiment 600 of the target. The target 600 may comprise a base portion 602 and a foldable portion 604. The base portion 602 may be in the shape of a semi-oval as shown, or take on other regular or irregular shapes as desired. The base portion 602 may include openings 606, 608 which allow the base portion 602 to be secured to a surface using fastening members (e.g., fastening members 348, 350). As discussed with respect to the other embodiments, the openings 606, 608 may take on any desired shape (e.g., may be circular, rectangular, triangular, comprise perpendicular slits as shown, et cetera). In other embodiments, instead of the openings 606, 608, the base portion 602 may at its underside comprise adhesive and a release liner which may be removed to expose the adhesive and allow the underside of the base portion 602 to be secured to a surface.

The foldable portion 604 may extend from the base portion 602, and more specifically, from a fold line 610. The foldable portion 604 may be generally rectangular as shown, or take on other regular or irregular shapes. The foldable portion 604 may, but need not, have rounded corners 612, 614, as shown in FIG. 18.

In the storage configuration 601A as shown in FIG. 18, the target 600 (as the other targets disclosed herein in their respective storage configurations) may be generally horizontal. To place the target 600 in the use configuration (not specifically shown), the foldable portion 604 may simply be folded along the fold line 610 such that it is generally perpendicular to the horizontal base portion 602. The base portion 602 may then (or prior to the folding) be secured to a surface using fastening members that may be passed through the openings 606, 608 (or via adhesive provided at the underside of the base portion 602 that is exposed upon the removal of the release liner). It will be appreciated that the configuration and construction of the target 600 may be such that the foldable portion 604 remains in a generally upright position in the use configuration once it is folded along the fold line 610. Of course, target indicia 420 and sign indicia 422 may be provided on the foldable portion 604 and sign indicia 422 may also be provided on the base portion 604.

Thus, as has been described, the targets (e.g., the targets 300, 300', 400, 400', 500, and 600) described herein may be formed inexpensively, be set up easily, and be versatile. Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A target of a unitary construction, comprising:

a self-supporting sign, comprising:

a middle portion having a first side, a second side, an upper side, and a lower side;

a first foldable flap extending from the first side; the first foldable flap configured to be folded along the first side in a use configuration;

a second foldable flap extending from the second side; the second foldable flap configured to be folded along the second side in the use configuration;

a front foldable portion extending from the lower side; the front foldable portion configured to be folded along the lower side in the use configuration; the front foldable portion comprising at least one opening configured for the passage of a fastening member therethrough;

wherein the front foldable portion is configured to be secured to a surface when the self-supporting sign is being used as a target;

wherein, in the use configuration:

the first foldable flap directly touches only the middle portion and the surface; and the second foldable flap directly touches only the middle portion and the surface.

2. The target of claim 1 wherein the at least one opening is formed by two perpendicular, intersecting slits.

3. The target of claim 2 wherein:

at least one of the front foldable portion, the first foldable flap, and the second foldable flap comprises a sign indicia; and the middle portion comprises a target indicia and the sign indicia.

4. The target of claim 1 wherein the front foldable portion comprises at a bottom surface an adhesive and a release liner.

5. The target of claim 1 wherein each of the first side, the second side, and the lower side comprises a slit to aid in the respective folding of the first foldable flap, the second foldable flap, and the front foldable portion with respect to the middle portion.

6. The target of claim 5 wherein the middle portion comprises removable target indicia.

7. The target of claim 6 wherein the first flap comprises a side edge; the side edge having a vertical portion and an angled portion that extends from the vertical portion.

8. The target of claim 6 wherein the front foldable portion has a rounded perimeter.

9. The target of claim 1 wherein each of the middle portion and the front foldable portion are rectangular.

10. The target of claim 9 wherein the middle portion comprises rounded corners.

11. The target of claim 1 wherein the front portion has a semi-oval shape.

12. A target of unitary construction, comprising:

a self-supporting sign, comprising:

a middle portion having a first side, a second side, an upper side, and a lower side;

a first foldable flap extending from the first side; the first foldable flap configured to be folded along the first side in a use configuration;

a second foldable flap extending from the second side; the second foldable flap configured to be folded along the second side in the use configuration;

a front foldable portion extending from the lower side; the front foldable portion configured to be folded along the lower side in the use configuration;

a first slit, a second slit, and a third slit; the first slit being between the middle portion and the first foldable flap; the second slit being between the middle portion and the second foldable flap; and the third slit being between the middle portion and the front foldable portion;

wherein, in the use configuration:

the front foldable portion is secured to a surface;

the first foldable flap directly touches only the middle portion and the surface; and the second foldable flap directly touches only the middle portion and the surface.

13. The target of claim 12, wherein the front foldable portion is configured to be secured to the surface using at least one of an adhesive and a fastening member.

14. The target of claim 13 wherein the front foldable portion comprises at least one opening configured for the passage of a fastening member therethrough.

15. The target of claim 14 wherein the at least one opening comprises a first opening and a second opening; each of the first and the second openings being at the same distance from the middle portion.

16. The target of claim 13, wherein the front foldable portion has on a lower surface adhesive and a release liner.

17. The target of claim 12 wherein the front foldable portion has a semi-oval shape.

18. The target of claim 12 wherein the middle portion comprises removable indicia.

19. The target of claim 12 wherein, in the use configuration, the middle portion forms an obtuse angle with the front foldable portion.

20. The target of claim 12 wherein, in the use configuration, only the front foldable portion is secured to the surface.

21. A target of a unitary construction, comprising:

a self-supporting sign, comprising:

a middle portion having a first side, a second side, an upper side, and a lower side;

a first foldable flap extending from the first side; the first foldable flap configured to be folded along the first side in a use configuration;

a second foldable flap extending from the second side; the second foldable flap configured to be folded along the second side in the use configuration;

a front foldable portion extending from the lower side; the front foldable portion comprising at a bottom surface an adhesive and a release liner; the front foldable portion configured to be folded along the lower side in the use configuration;

wherein the front foldable portion is configured to be secured to a surface when the self-supporting sign is being used as a target;

wherein, in the use configuration:

the first foldable flap directly touches only the middle portion and the surface; and the second foldable flap directly touches only the middle portion and the surface.

* * * * *